US006655055B2

(12) United States Patent
Loger et al.

(10) Patent No.: US 6,655,055 B2
(45) Date of Patent: Dec. 2, 2003

(54) ACTIVE IRONING BOARD

(75) Inventors: Jean-Michel Loger, Brumath (FR); Carlo Papetti, Schiltigheim (FR); Johannes Roussel, Rosenwiller (FR)

(73) Assignee: Esse 85 S.r.l., Susegana (IT)

( * ) Notice: Subject to any disclaimer, the term of this patent is extended or adjusted under 35 U.S.C. 154(b) by 0 days.

(21) Appl. No.: 10/080,514

(22) Filed: Feb. 25, 2002

(65) Prior Publication Data

US 2002/0121032 A1 Sep. 5, 2002

(30) Foreign Application Priority Data

Feb. 23, 2001 (FR) ..... 01 02508

(51) Int. Cl.[7] ..... D06F 81/08
(52) U.S. Cl. ..... 38/137
(58) Field of Search ..... 38/107, 135, 137, 38/140, 103

(56) References Cited

U.S. PATENT DOCUMENTS

| | | | | | |
|---|---|---|---|---|---|
| 2,029,856 | A | * | 2/1936 | Collette | 38/140 |
| 2,495,468 | A | * | 1/1950 | Mueller | 38/104 |
| 2,645,046 | A | * | 7/1953 | Frej | 38/137 |
| 4,442,616 | A | * | 4/1984 | Hauser et al. | 38/14 |
| 5,669,164 | A | * | 9/1997 | Voitchovsky | 38/137 |
| 6,151,817 | A | * | 11/2000 | Eiben | 38/135 |

* cited by examiner

*Primary Examiner*—Ismael Izaguirre
(74) *Attorney, Agent, or Firm*—Browdy and Neimark, P.L.L.C.

(57) ABSTRACT

The object of this invention is an active ironing board. This board includes a perforated plane support, for example a metal grill, covered by a covering material that is permeable to gases, usually a cover, which forms the ironing surface and under which there is a suction compartment bound by a lower support panel where at least one ventilating unit or similar is mounted to suck in gases present in the suction compartment and push them outside, the lower support panel being also permeable to gasses.

17 Claims, 2 Drawing Sheets

2'
7
8
3
6'
6
2
6"
9
1
5
4
8
2'
7

3
2
AIR + STEAM
5
STEAM
AIR
AIR
8
4
7
2'

ACTIVE IRONING BOARD

BACKGROUND OF THE INVENTION

This invention deals with domestic appliances and professional equipment, and more specifically equipment used for ironing, and involves an active ironing board, of simple construction, which is more efficient than current active ironing boards.

Ironing techniques, like the domestic and professional appliances used for this type of work, have greatly evolved over recent years.

In fact, in the past, all ironing was actually done using only dry irons.

These were followed by steam irons, and nowadays, the market is oriented towards steam generated ironing units.

The release of steam produced by this new generation of appliances has become increasingly important: from the 30 g/min produced in the past to the over 100 g/min of some appliances produced today. The result is better quality ironing. In return however, the ironing board must release an increasing volume of steam.

In order to adapt to steam ironing, industries initially came up with ironing boards that enabled steam to easily pass through (passive board called "steam special").

A more common solution is the use of a perforated surface made of flat metal. A cover made of thick flannel in placed over this surface to offer more comfortable ironing.

This is inexpensive technology and the steam can easily pass through the cover and the table.

However, after passing through the table, the steam rises up towards the user which can be very unpleasant. Furthermore, the steam condenses over the metal parts of the board and the drops that form under the table fall onto the floor. Furthermore, the cover remains damp, and this makes it difficult to keep the ironing dry.

In an attempt to temporarily resolve this inconvenience and in particular, prevent steam condensation, new technical solutions have been developed. This new technology has been applied to those products available on the market as "active board".

These existing active boards are equipped with ventilators that serve to suck in and blow out air and steam through the cover.

A watertight compartment has been built under the surface of the board which, by creating a closed compartment, makes it possible to channel air and steam from the board to the ventilator and back to avoid drops of condensation from falling below (water retention). This fully watertight compartment situated below is usually bounded by at least one continuous bulkhead make of steel or plastic material.

Furthermore, the movement of air through the cover ensures that it is kept dry.

Some at times are equipped with a heating system made up of a peripheral heating element that makes it possible to heat the board from below. This supplementary system helps to maintain the cover dry, especially when the ventilation is not switched on.

There are many advantages to these active boards, in particular: the cover is always dry, which improves the quality and comfort of ironing; the steam does not rise towards the user; the air suction and release function prevents fabric creasing, reduced temperature and makes ironing easier.

However, this is a costly solution due to the presence of an integrated ventilating unit and heating system.

Furthermore, the watertight compartment situated under the board is currently built with a steel or plastic support frame that needs to hold heavy equipment. This continuous and massive frame is cold and causes steam to condense. In this manner, the water stays in this compartment and when the board is folded for storage this water flows to the bottom of the frame and comes into contact with the cover. Consequently, when it dries up, the tip of the cover has a rust-colored stain.

SUMMARY OF THE INVENTION

The particular scope of this invention is to at least partially resolve some of the inconveniences of active boards mentioned above, and prevent condensate from forming in the compartment underneath the board.

For this purpose, this invention involves an ironing or active ironing board with a perforated plane support formed for example, by a metal grill, covered over with a covering material that is permeable to gases, usually a cover, that forms the ironing surface under which there is a suction compartment delimited by a lower support panel where at least one ventilating unit or similar suction unit is mounted to expel gasses present in the suction compartment to the outside, with the lower support panel also permeable to gases.

BRIEF DESCRIPTION OF THE DRAWINGS

The following description, which refers to a preferred means of implementation, will provide a better understanding of this invention, which is only an example and is not binding. The explanations refer to the attached layout designs where.

DESCRIPTION OF THE PREFERRED EMBODIMENT

Figure 1:
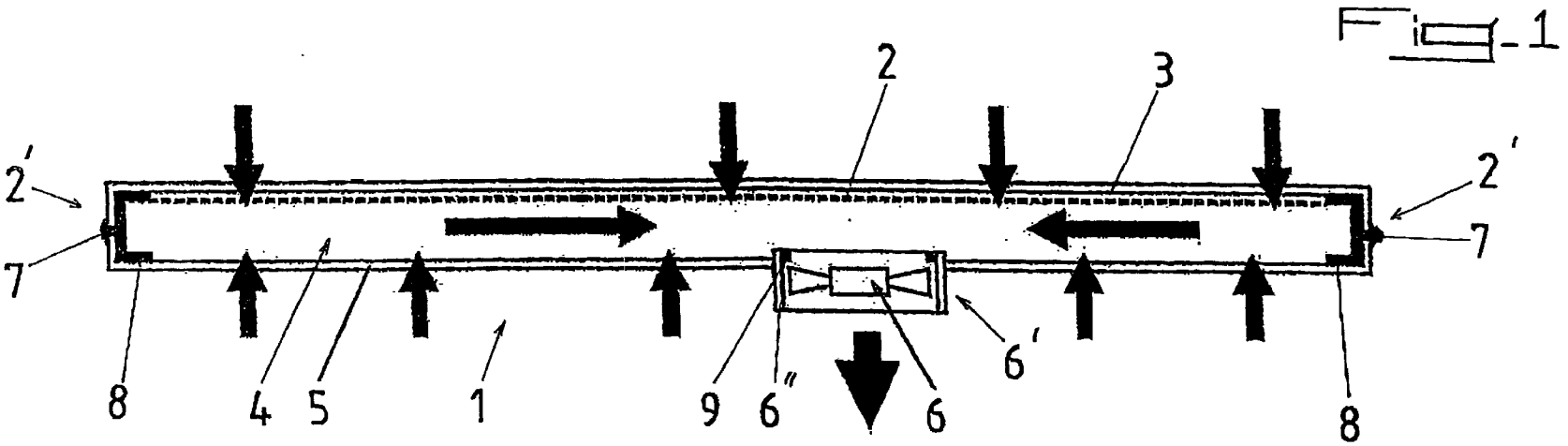
FIG. 1 is a partial view of the longitudinal section and side elevation of the active ironing board of this invention, but without the support frame.
Figure 2:
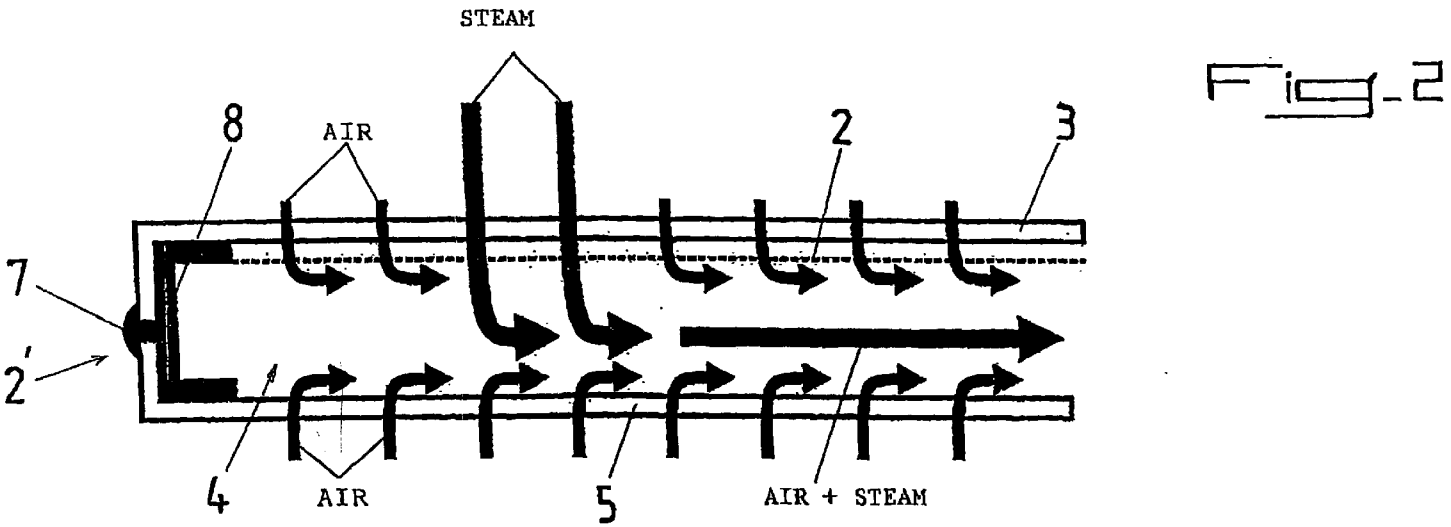
FIG. 2 is a detailed view, on another scale, of part of the object shown in FIG. 1, showing details of the flow of gas that circulates in the board during the suction phase.

As shown in FIGS. 1 and 2 of the attached drawings, active ironing board 1 includes a perforated plane support 2 equipped with a plurality of holes spread throughout the all surface, for example a metal grill, covered with a covering material 3 that is permeable to gases, generally a cover, that forms the ironing surface. Under this plane support 2 there is a suction compartment 4 delimited by a lower support panel 5 where at least one ventilating unit 6 or similar equipment is mounted to aspire gases present in the suction compartment 4 and push them to the outside (preferably downwards where board 1 is installed).

In compliance with the invention, substantially the entire surface of the lower support panel 5 is also preferably permeable to gases, whether evenly or not.

With this arrangement, the air can circulate in the suction compartment 4, either pulled in or blown out, as well as through the cover and lower support panel 5, without any dead corners.

During suction, all the humidity found in the above mentioned suction compartment 4 is aspirated and all support panels that bind the above mentioned compartment 4 are permanently dried.

Furthermore, as shown in FIG. 2 of the attached drawings, the double flow of gas (upper and lower) produced when suction air is introduced (forming a depression in compartment 4) through the covering material 3 and lower support panel 5, makes it possible to expel all the steam released by the iron directly into a pseudo-laminar drain, and simultaneously expel all the steam that was released by the iron through the cover+support group to the outside, thereby greatly reducing any possibility of condensate in the compartment 4 or on the elements situated in the above mentioned compartment.

Furthermore, all the condensate that nevertheless forms in compartment 4, or deposits on the support panel that binds it, will quickly be eliminated by forced or active drying.

When required by the size of the board 1, more than one ventilating unit can be included.

However, it is advantageously fitted with only one appropriately adjusted ventilating unit 6, with a reverse function, that is controlled by the user. The above mentioned ventilating unit 6 should preferably function continuously during the entire ironing session and, if needed, for a certain period of time after the ironing session is over in order to ensure that the board 1 is completely dry, especially when a large volume of steam is produced.

In the preferred version of this invention, the lower support panel 5 is substantially situated on a surface parallel to the rigid perforated plane support 2 and delimits, with its covering material 3, a closed, evidently plate shaped, suction compartment 4 that extends under the entire lower part of the perforated plane support 2 and has the same edge shape as the table 1.

The permeability of the material that forms the lower support panel 5 can be arranged based on the type of circulation desired in the compartment 4 and must be compatible with the use that is to be made.

However, to obtain a balanced laminar flow, the permeability of the above mentioned material will be almost identical to that of the top covering material 3.

As a result of this arrangement, the steam is carried by the upper and lower flows combined. They enter rather uniformly from the top and the bottom of compartment 4 of the board 1.

A sort of air cushion forms over the entire surface under of the board that prevents the drops of steam that come from the top of the board to deposit themselves on the bottom of the compartment or on other elements therein. If, nevertheless, should any drops of steam fall on the porous material of the lower support panel 5, they will be subjected to a continuous flow of air that will cause them to evaporate (see FIG. 2).

Advantageously the lower support panel 5 is appropriately build with the same porous material as the cover 3 that covers the top of the perforated plane support 2 and is equally permeable to gases.

In the preferred version of this invention, the covering material 3 and the lower support panel 5 are made of textile material, preferably in thick flannel.

To obtain a completely closed compartment, with an easily removable cover 3 and lower support panel 5, it expected that the covering material 3 and flexible material that form the lower support panel 5 will be connected directly or indirectly by the outer edge 2' of the plane support 2 with removable, preferably continuous, connecting means 7 and that extends on all edge 2' to obtain a suction compartment 4 below that is closed on all sides.

Advantageously the connecting means 7 will preferably slide close.

However, it is also possible to make the material for the cover 3 and lower support panel 5 partially overlap the edge and fasten it with an elastic band, studs, hooks and eyes, magnetic bands or similar around the circumference.

In order for the board structure 1 to be simple, rigid and at the same time easy to manufacture, the plane support 2 can have a trimmed edge 8, preferably with a U section, that extends underneath the above mentioned support 2 and delimits, at least structurally, the side support panel for the suction compartment below 4, the upper covering material 3 and the lower support panel 5 that are fastened on or mounted over the above mentioned trimmed edge 8 that serves as a structure and makes it rigid.

Hence, the external side of the above mentioned edge can either be covered or not covered by the covering material 3 and by the lower support panel 5, since this stretches over the above mentioned edge 8 like a cover.

To ensure the structural continuity of the lower part that delimits the compartment 4, the support frame 6' of the ventilating unit 6 is connected along the entire outer edge of the lower support panel 5 in a continuous manner, and is fitted with a means 9 for retaining any condensate that could form on the inner panels of the suction compartment 4, the above mentioned means of retention 9 being exposed to the flow of gases that flow in or out through the above mentioned ventilating unit 6, and being substantially formed by a stretch of cell-like material that spreads out across the circumference of part 6" of unit 6' like a muff that supports the fan for the above mentioned ventilating unit 6.

Figure 3:
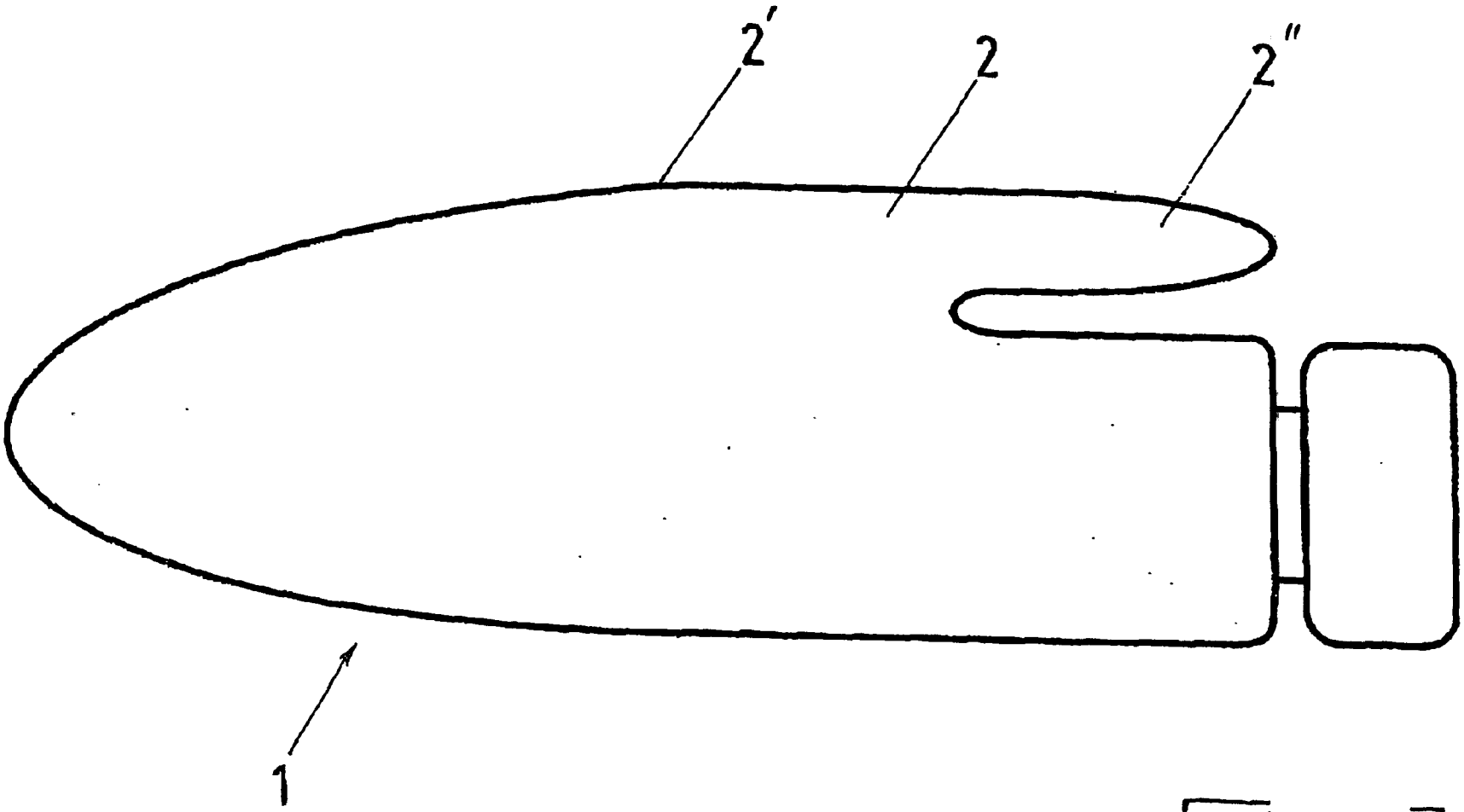
FIG. 3 is a top view of the active board of this invention, that includes a sleeve board.

In another version of this invention, shown schematically in FIG. 3 of the attached drawings, part of the structure of the perforated plane support 2 has a 2" section with a sharp configuration that forms a support for the sleeve board.

With this arrangement the separate piece or supplementary accessory can be eliminated together with its corresponding fastening points that would otherwise be included on the board 1.

The shape of the outer edge 8, the cover 3 and the lower support panel 5 can easily be adapted to this particular shape of the plane support 2.

Compared to a regular active board, the advantages of this invention are as follows:

- the lower part is made of porous material and remains dry;
- water does not condense or stagnate in the board;
- stains do not form on the tip of the board when it is stored in vertical position;
- the board does not need to be heated;
- the lower part of the board can be produced without having to purchase a mould for plastic materials or for shaping metals. Various types of boards can be produced with minimum investment (for example, with an incorporated sleeve board).

Naturally, the invention is not restricted by the manufacturing methods described and shown in the attached drawings. Changes are possible, in particular with regards to forming various elements or substituting equivalent techniques, without however deviating from the restrictions posed by the invention.

What is claimed:

1. Active ironing board with a perforated plane support, covered on an upper surface thereof with a covering material that is permeable to gasses and which forms the ironing surface, and under which there is a closed suction compartment delimited thereabove by the covering material and below by a lower support panel having a main opening to which at least one ventilating unit is connected, said ventilating unit being able to suck gases found in the suction compartment and release them to the outside, wherein the lower support panel is also permeable to gases outside the main opening to which the ventilating unit is connected.

2. Active ironing board as in claim 1, having only one ventilating unit with reversible functions that is controlled by the user, said ventilating unit being able to run continuously during ironing.

3. Active ironing board, as in claim 1, wherein the lower support panel is substantially situated parallel to the rigid perforated plane support and delimits, with the above mentioned covering material, a substantially plate shaped compartment that extends over all a bottom surface of the perforated plane support and has the same side profile as the board.

4. Active ironing board, as in claim 1, wherein the lower support panel is made of the same material as the covering material and has the same permeability to gases as the covering material itself.

5. Active ironing board, as in claim 1, wherein the covering material and the lower support panel, are made of textile material.

6. Active ironing board, as in claim 5, wherein the covering material and the lower support panel, are made of thick flannel.

7. Active ironing board as in claim 1, wherein the covering material and the lower support panel, are bound either directly or indirectly by a surrounding edge of the plane support with removable connecting means that extends over the entire edge in order to form a suction compartment underneath that is closed on all sides.

8. Active ironing board, as in claim 7, wherein the connecting means is made of a sliding closure.

9. Active ironing board, as in claim 7, wherein said connecting means are continuous.

10. Active ironing board, as in claim 1, wherein the plane support has an outer edge, that extends under the above mentioned support, which delimits, at least structurally, a side support panel of the suction compartment below, with the covering material and the support panel fastened on or mounted over the above mentioned outer edge forming a structure and strengthening it.

11. Active ironing board, as in claim 10, wherein the outer edge of the plane support has a U section.

12. Active ironing board, as in claim 1, further comprising a ventilation support unit of the ventilating unit connected to the lower support panel in a continuous manner along an entire outer edge and fitted with a means for retaining any condensate that could form over the part facing the suction compartment, the above mentioned retention means being exposed to the flow of gas that enters and exits through the above mentioned ventilating unit.

13. Active ironing board, as in claim 12, wherein the retention means consists of a cell-like material stretch that extends circumferentially over a part of body formed as a sleeve and housing the fan for the above mentioned ventilating unit.

14. Active ironing board, as in claim 1, wherein the structure of the perforated plane support includes a part with a sharp configuration that forms the support unit for the sleeve board.

15. Active ironing board as in claim 1 wherein said perforated plane support is a metal grill.

16. Active ironing board with a perforated plane support, covered on an upper surface thereof with a covering material permeable to gasses and forming an ironing surface a suction compartment below said perforated plane support and delimited by a lower support panel which contains at least one ventilating or similar unit that sucks gases found in the suction compartment and releases them to the outside, wherein the lower support panel is also permeable to gases and, with the covering material that covers the perforated plane support, delimits a closed suction compartment, and wherein the covering material and the lower support panel both comprise textile materials.

17. Active ironing board with a perforated plane support, covered on an upper surface thereof with a covering material permeable to gasses and forming an ironing surface, a suction compartment below said perforated plane support and delimited by a lower support panel which contains at least one ventilating or similar unit that sucks gases found in the suction compartment and releases them to the outside, wherein the lower support panel is also permeable to gases and, with the covering material that covers the perforated plane support, delimits a closed suction compartment, and wherein the structure of the perforated plane support includes a part with a sharp configuration that forms the support unit for a sleeve board.

* * * * *